US010105586B1

(12) United States Patent
Olsen-Lund

(10) Patent No.: US 10,105,586 B1
(45) Date of Patent: Oct. 23, 2018

(54) MOUNTING SYSTEM FOR SNOWBOARD BINDINGS AND SNOWBOARD BINDING INCLUDING SAME

(71) Applicant: Tristan Olsen-Lund, Cedar City, UT (US)

(72) Inventor: Tristan Olsen-Lund, Cedar City, UT (US)

( * ) Notice: Subject to any disclaimer, the term of this patent is extended or adjusted under 35 U.S.C. 154(b) by 0 days.

(21) Appl. No.: 15/653,750

(22) Filed: Jul. 19, 2017

(51) Int. Cl.
*A63C 5/12* (2006.01)
*A63C 10/20* (2012.01)
*A63C 10/14* (2012.01)

(52) U.S. Cl.
CPC ..... *A63C 5/128* (2013.01); *A63C 10/14* (2013.01); *A63C 10/20* (2013.01)

(58) Field of Classification Search
CPC ..... A63C 5/128; A63C 10/14–10/145; A63C 10/20
See application file for complete search history.

(56) References Cited

U.S. PATENT DOCUMENTS 5,890,729 A * 4/1999 Bayer ..... A63C 10/18 280/618
6,065,767 A * 5/2000 Girotto ..... A63C 10/10 280/14.21
6,290,423 B1 * 9/2001 Jungkind ..... A63C 10/10 280/607
2003/0047913 A1 * 3/2003 Holzer ..... A63C 5/128 280/617
2003/0230870 A1 * 12/2003 Sabol ..... A63C 10/14 280/618
2004/0207179 A1 * 10/2004 Sacco ..... A63C 10/14 280/623
2006/0273550 A1 * 12/2006 Delago ..... A63C 10/04 280/607
2007/0290463 A1 * 12/2007 White ..... A63C 10/18 280/14.24
2008/0309052 A1 * 12/2008 Neiley ..... A63C 10/18 280/613
2013/0113184 A1 * 5/2013 Pelchat ..... A63C 10/16 280/607
2014/0097596 A1 * 4/2014 Fumagalli ..... A63C 10/18 280/611
2015/0031253 A1 * 1/2015 Reguis ..... A63C 10/16 441/74
2017/0274270 A1 * 9/2017 Lundbaek ..... A63C 10/18

* cited by examiner

*Primary Examiner* — Erez Gurari
(74) *Attorney, Agent, or Firm* — Holland & Hart LLP

(57) ABSTRACT

A snowboard binding mounting system. The system includes a base plate and a main gear disposed on the base plate, the base plate engageable with a snowboard binding, the base plate having a plurality of screw openings each extending through the base plate and disposed around a circumference defined by the main gear; a plurality of pinion gears disposed on the base plate and meshed with the main gear, each pinion gear having a shaft opening aligned with a corresponding one of the screw openings; and a plurality of screws, each screw defining a shaft that extends through one of the pinion gear shaft openings and the corresponding screw opening.

18 Claims, 9 Drawing Sheets

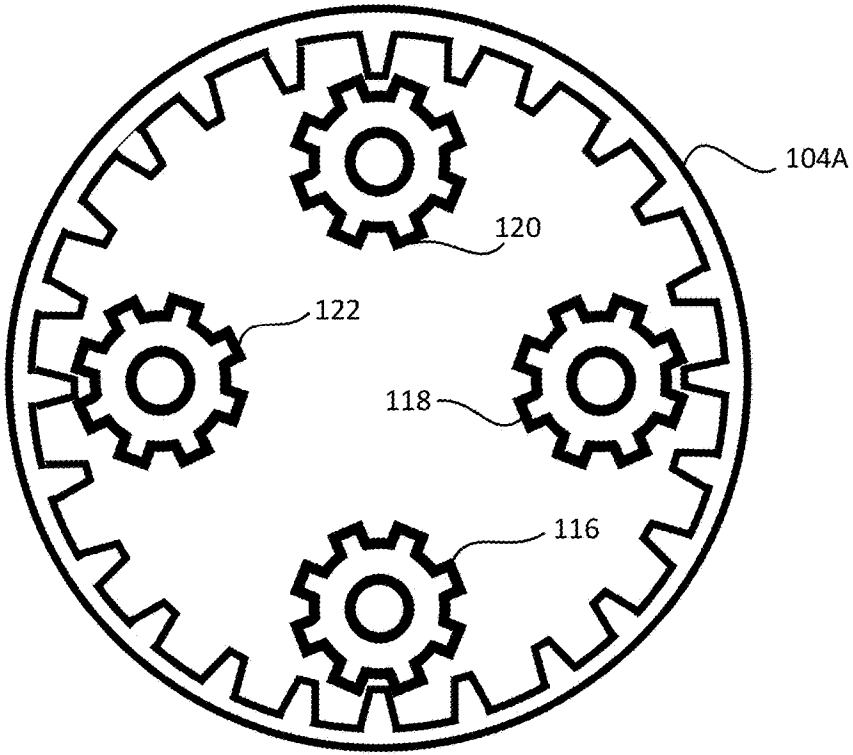
Figure 1A (New)

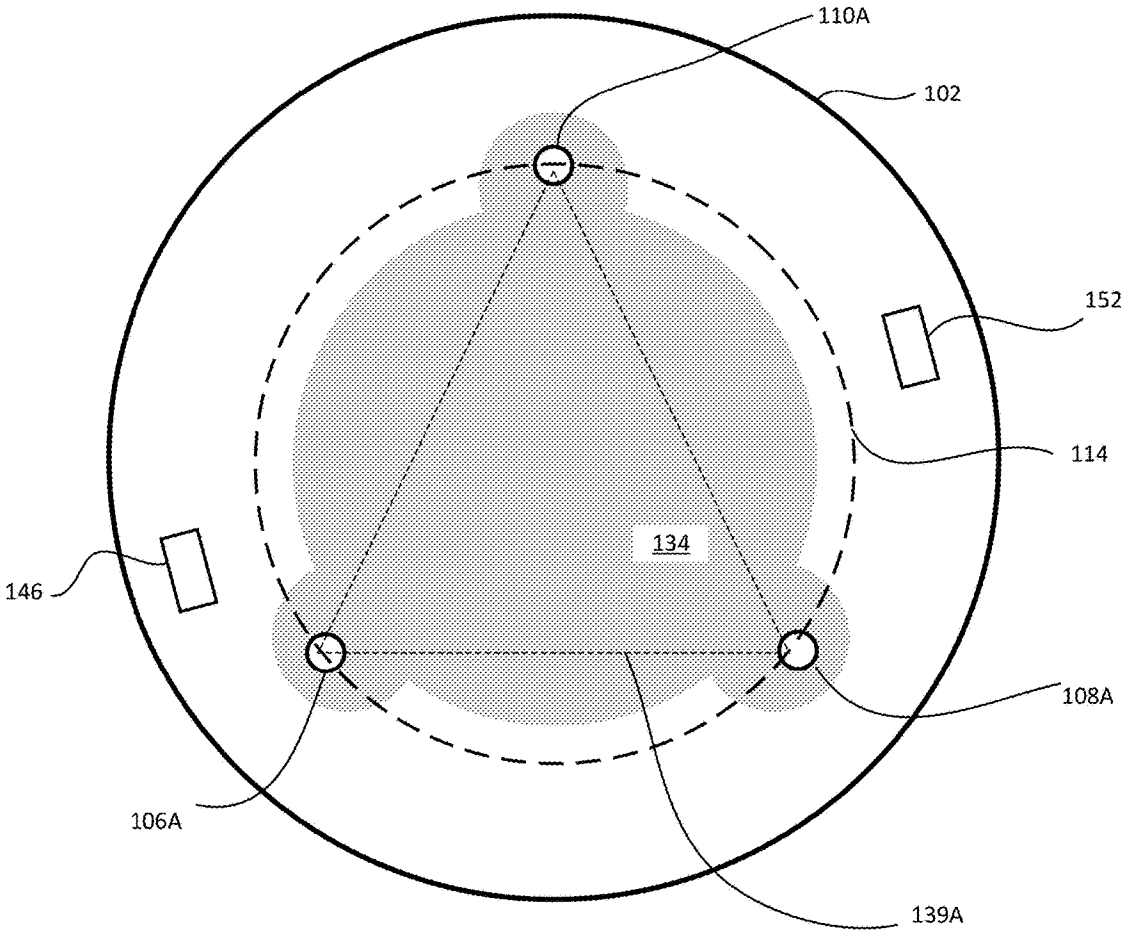
Figure 2A (New)

MOUNTING SYSTEM FOR SNOWBOARD BINDINGS AND SNOWBOARD BINDING INCLUDING SAME

FIELD OF THE INVENTION

This invention relates to the general field of snowboarding and more particularly to the field of bindings for snowboards.

BACKGROUND

Snowboarding has become a major sport and is enjoyed by millions of snowboard riders in the U.S.A. and in many other countries the world over. A complete snowboard setup comprises the board itself and a pair of bindings that couple the rider's boots to the board. Threaded inserts are fixed in an upper surface of the board, and each binding is connected to the board by machine screws that pass through a base plate of the binding into the threaded inserts. Typically the threads are 6 millimeters (mm) in diameter and the screws are Phillips oval-head 6 mm screws long enough to extend through the base plate into the inserts; a length of 12 mm is common although some bindings may require longer or shorter screws.

Most snowboards have more inserts than are needed to secure the bindings to the board. This is so that the bindings can be placed in any of a plurality of locations according to the preference of the rider. Typically some inserts are arranged in two parallel rows near the nose of the board, oriented along the board's longitudinal axis, and other inserts are similarly arranged near the tail. The rows are spaced 40 mm from each other and the inserts in each row are spaced either 20 mm or 40 mm apart. A typical board has two such rows of inserts, with six to eight inserts in each row, near the nose, for mounting the leading-foot binding. Similarly, two rows of inserts are located near the tail for mounting the trailing-foot binding.

The base plate may have four screw holes spaced 40 mm apart to define a 40×40 mm square with one hole at each corner. Some base plates have more than four holes, and some have slots that can accommodate a screw at any position along the slot, to give a greater range of possible mounting positions. Regardless of the number of holes in the base plate or whether the holes are round or slot-shaped, four screws are used to mount the base plate to the board using four of the inserts.

The base plate typically has a beveled edge that mates with a correspondingly-beveled edge in an opening in a mounting plate of the binding. When the base plate is screwed tightly on to the board, these edges engage and the mounting plate is clamped to the board. These beveled edges commonly have mating serrations similar to the teeth of a gear, and when the base plate is tightened onto the board these serrations mesh, locking the mounting plate securely to the base plate and through it to the board.

The angular orientation of the base plate relative to a lateral axis of the board is fixed by the inserts and the mounting holes. But the mounting plate can be rotated about its vertical axis into any of a plurality of angular orientations relative to the lateral axis. For example, the serrations may be configured such that any angular multiple of 3° may be selected. This permits the binding to be rotated to an angle of ±3°, 6°, 9°, etc., relative to the lateral axis, where a positive angle indicates that the binding is rotated so that the toe points toward the nose of the board.

Although most bindings are secured using four screws, some boards use a three-screw mounting system in which the inserts are irregularly spaced along the longitudinal axis of the board and the base plate has holes arranged in a generally-triangular pattern to allow for positioning the mounting plate in any desired angular rotation and in any of a plurality of longitudinal positions as desired by the rider.

Some riders choose positive angles for both feet with the trailing foot at a smaller angle. This kind of orientation is often preferred for alpine racing and for some big-mountain riding. Angles may be set to +20° or more for the leading foot and +12° or more for the trailing foot. Other riders prefer a "duck foot" stance in which the leading toe points toward the nose of the board and the trailing toe points toward the tail; this is often preferred by freestyle riders, especially for doing tricks in terrain parks and half pipes. A duck-foot rider may choose angles such as +12° and −6° for leading and trailing bindings, respectively. Others may select wider angles and a symmetrical stance such as ±15°.

It is important that the screws remain tight despite shocks and vibration that occur when snowboarding so that the rider's boots remain coupled to the board in the desired orientation. Lock washers are sometimes disposed on the screw between the screw head and the base plate. A chemical thread holder such as "Loctite" made by Henkel AG of Düsseldorf, Germany, is sometimes applied to the threads to prevent the screw from loosening. In addition, many ski resorts provide workbenches and screwdrivers so that riders can tighten the screws as needed during a day of riding.

If a rider wishes to change the stance angle, the screws holding the base plate must be loosened enough to permit the mounting plate to rotate under the base plate, and then the mounting plate is rotated to the desired stance angle and the screws are re-tightened. This may happen frequently, either as a rider moves from one style of riding to another, or if a rider wants to experiment with various stance angles.

If a rider wishes to change the stance width, by moving the bindings closer together or further apart, or if the rider wishes to reconfigure between regular and goofy stance, the screws holding the base plate must be removed so that the base plate can be relocated as desired.

SUMMARY

The inventor believes he has discovered various problems with the foregoing. Even if a chemical thread holder was used, the screws that secure the base plate to the snowboard may come loose due to mechanical stresses and vibration inherent in riding a snowboard over various kinds of terrain and in varying snow and ice conditions encountered at ski resorts. Loose screws can lead to sudden rotation or shifting of the binding relative to the board or even to the binding completely detaching from the board. At best, loose bindings are a nuisance; at worst, a loose binding can lead to an accident and injury. Some riders carry a screwdriver with them to deal with loose screws, but this is inconvenient and still requires the rider to stop and unstrap the binding from the boots in order to tighten the screws. Otherwise the rider must find a workbench and tools somewhere on the ski resort to tighten the screws. Also, a rider wishing to change stance angle or setup must individually loosen or remove from 3 to as many as 8 screws, depending on whether one or both bindings are to be adjusted, a time-consuming and annoying process. A solution to these problems is provided herein.

Briefly and in general terms, in one embodiment a snowboard binding mounting system is provided. The system includes a base plate and a main gear disposed on the base plate. The base plate is engageable with a snowboard binding. The base plate has a plurality of screw openings each extending through the base plate and disposed around a circumference defined by the main gear. Pinion gears are disposed on the base plate and meshed with the main gear. Each pinion gear has a shaft opening aligned with a corresponding one of the screw openings. A plurality of screws, one for each pinion gear, are included. Each screw defines a shaft that extends through one of the pinion gear shaft openings and the corresponding screw opening.

In some embodiments the base plate defines a recessed area and the main gear and pinion gears are disposed in the recessed area, Typically the base plate is round. A peripheral edge of the base plate may be engageable with a complementary edge of an opening in a mounting plate of the snowboard binding; the peripheral edge of the base plate may be beveled and serrated, and the opening in the mounting plate matingly beveled and serrated.

In some embodiments the screw openings define a square about 40 mm on a side with one screw opening at each corner of the square. In other embodiments the screw openings define a triangle with one opening at each vertex of the triangle.

In some embodiments each screw is rigidly connected to its corresponding pinion gear, but in other embodiments the screw may be frictionally engaged with its corresponding pinion gear, to permit the screw to be turned, for example with a screwdriver, while the gear remains stationary.

In some embodiments the main gear comprises an internal gear disposed around the pinion gears, an "internal" gear being an annular material such as metal that has gear teeth on its internal perimeter. In other embodiments the main gear comprises an external gear disposed between the pinion gears, an "external" gear being one that has teeth on an exterior surface such as that of a cylinder.

When in position the main gear locks all four pinion gears together such that no one of them can rotate by itself, tending to prevent any screw from working its way loose. In some embodiments the main gear may be locked to the base plate, for example by means of a shaft having a flattened side that engages a corresponding shaft hole in the base plate, to further resist any loosening of the screws. In some embodiments a key may be coupled to the main gear so that the gear may be rotated by hand. This permits a rider to loosen and tighten all screws at once, simplifying the task of changing the stance angle. Or the main gear can be lifted out so that the screws can be adjusted individually if need be. The key may be foldable onto the main gear or removable when not in use.

In some embodiments a retainer arm is provided to hold the main gear in place. The retainer arm has a first extremity foldingly coupled to the base plate and a second extremity detachably connectable to the base plate. In other embodiments, for example for use with bindings that have a built-in cover over the base plate, the retainer arm may be omitted, the built-in cover serving the same purpose as the retainer arm.

In another embodiment, a snowboard binding mounting system includes a circular base plate having a beveled peripheral edge complemental with an edge of a base-plate opening in a mounting plate of a snowboard binding, a recessed area defined in an upper surface of the base plate and four screw openings defined through the base plate at regular intervals around the recessed area. A main gear is centered in the recessed area of the base plate. Four pinion gears are meshed with the main gear, each having a shaft opening aligned with one of the screw openings. Four screws are included, each screw defining a shaft connected to one of the pinion gears and extending through the shaft opening of that pinion gear and through the corresponding screw opening. A key is foldingly coupled to the main gear.

Complemental serrations may be formed in the beveled peripheral edge of the base plate and the edge of the base-plate opening in the mounting plate in some embodiments. A pin may be disposed in a notch defined in an edge of the key, and the pin extends through an extremity of a shaft connected to the main gear, so that the key when unfolded can be used to rotate the main gear and when not needed can be folded flat out of the way against the main gear.

Some embodiments may include a retainer arm extending across the main gear. A hinge couples a first extremity of the retainer arm to the base plate, and a clip detachably couples a second extremity of the retainer arm to the baseplate.

An embodiment of a snowboard binding including a binding mounting system includes a mounting plate having an opening therethrough; a highback connected to a heelside extremity of the mounting plate; an ankle strap extending across the mounting plate adjacent the highback; a toe strap extending across the mounting plate opposite the ankle strap; a circular base plate having a beveled peripheral edge complemental with an edge of the opening in the mounting plate, a recessed area defined in an upper surface of the base plate and four screw openings defined through the base plate at regular intervals around the recessed area; a main gear centered in the recessed area of the base plate; four pinion gears each meshed with the main gear and each having a shaft opening aligned with one of the screw openings; four screws each defining a shaft connected to one of the pinion gears and extending through the shaft opening of that pinion gear and through the corresponding screw opening; a key foldingly coupled to the main gear; and a detachable cover extending over the base plate and at least a portion of the mounting plate.

An embodiment of a method of operating a snowboard binding system such as that described above includes inserting a base plate into an opening in a mounting plate of a snowboard binding, affixing the base plate to a snowboard using screws connected to pinion gears in the base plate so as to clamp the binding to the board, positioning a main gear on the base plate to engage the pinion gears and prevent the screws from turning individually. Then if it is desired to reset the binding or to remove it from the board, the main gear is manually turned, in some embodiments by a folding turnkey, to loosen or tighten all the screws at once.

BRIEF DESCRIPTION OF THE DRAWINGS

FIG. 1A is a top view of an embodiment similar to that shown in FIG. 1 but with an internal gear rather than an external gear.

FIG. 2A is similar to FIG. 2 but illustrates an embodiment with three screw openings to accommodate three pinion gears rather than four.

DETAILED DESCRIPTION

Figure 1:
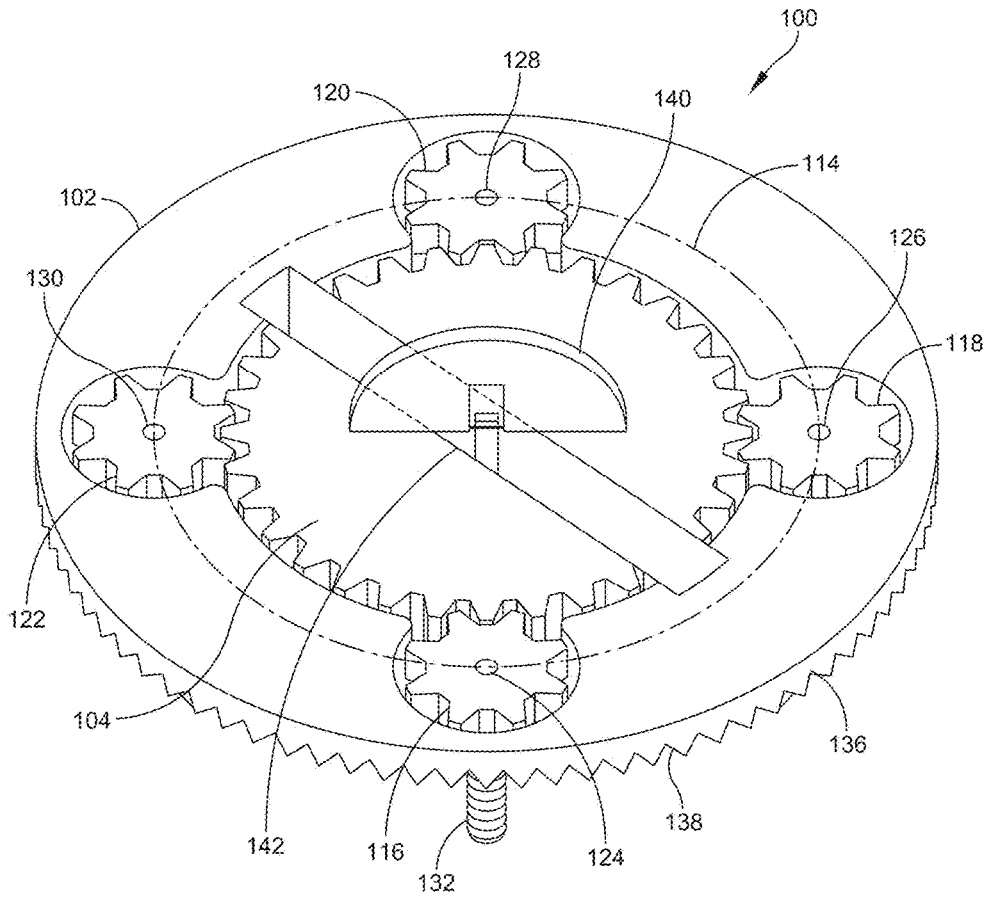
FIG. 1 is a perspective view of an embodiment of a snowboard binding mounting system.
Figure 2:
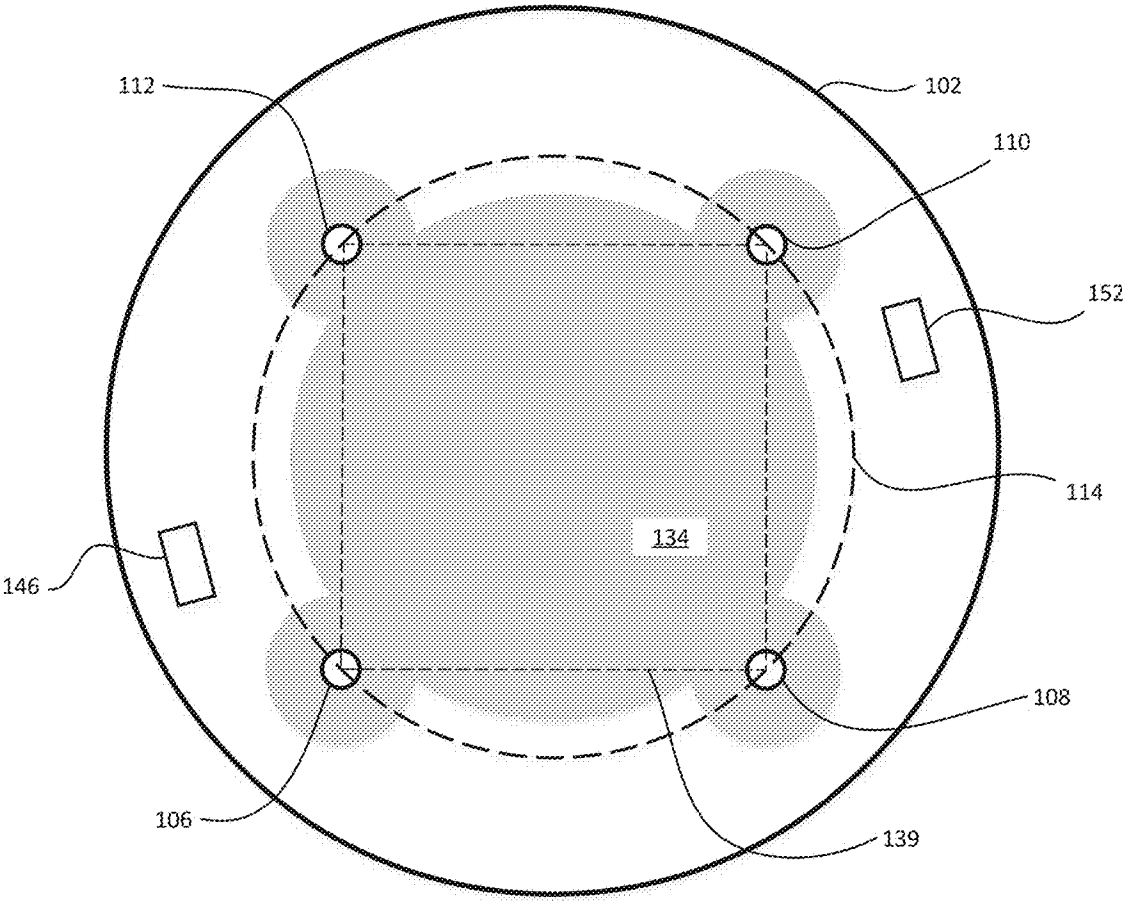
FIG. 2 is a top view of an embodiment of a base plate of the system shown in FIG. 1.

FIGS. 1 and 2 illustrate an embodiment of a snowboard binding mounting system generally 100. The system includes a base plate 102 and a main gear 104 disposed on the base plate. The base plate 102 is engageable with a snowboard binding (see FIG. 6). The base plate has a plurality of screw openings 106, 108, 110, and 112, each extending through the base plate and disposed around a circumference 114 defined by the main gear 104; the circumference 114 is slightly larger than the physical gear 104. A plurality of pinion gears 116, 118, 120, and 122 are disposed on the base plate 102 and meshed with the main gear 104, each pinion gear having a shaft opening (not visible) aligned with a corresponding one of the screw openings. The system includes a plurality of screws 124, 126, 128, and 130, each screw defining a shaft that extends through one of the pinion gear shaft openings and the corresponding screw opening, as shown by a threaded portion 132 of the screw 124 extending below the base plate 102.

In the embodiment shown, the base plate 102 defines a recessed area 134 as best shown in FIG. 2, and the main gear 104 and pinion gears 116, 118, 120, and 122 are disposed in the recessed area as shown in FIG. 1. In some embodiments (not shown) there is no recessed area and the gears are disposed on an upper surface of the base plate 102. The base plate 102 is round although in some embodiments the base plate may be elongated or some other shape.

A peripheral edge 136 of the base plate 102 is engageable with a complementary edge of an opening in a mounting plate of the snowboard binding. The peripheral edge 136 of the base plate may be beveled and serrated with serrations 138, and the opening in the mounting plate may be matingly beveled and serrated as will be discussed presently with reference to FIG. 6.

The screw openings may define a square 139 about 40 mm on a side with one screw opening at each corner of the square. The spacing of 40 mm is used by several snowboard manufacturers for the distance between threaded binding mounts in the snowboard In another embodiment (shown in FIG. 2A), three screw openings 106A, 108A, and 100A are provided around the circumference 114. These openings define a triangle 139A with one opening at each vertex of the triangle. In this embodiment there would be three pinion gears rather than four. This arrangement may be used, for example, for attachment to some models of snowboards made by Burton Snowboard Co. that use a triangular pattern for threaded binding mounts in the snowboard.

In some embodiments each screw, for example the screw 124, is rigidly connected to its corresponding pinion gear, for example the pinion gear 116. In other embodiments each screw may be frictionally engaged with its corresponding pinion gear.

The main gear 104 as illustrated comprises an external gear disposed between the pinion gears 116, 118, 120, and 122. However, in some embodiments (for example, as shown in FIG. 1A) the main gear may instead comprise an internal gear 104A disposed around the pinion gears.

A key 140 is coupled to the main gear 104 and is foldable flat against the main gear when not in use, to enable a snowboard rider to place a boot in the binding directly over the system 100.

Figure 3:
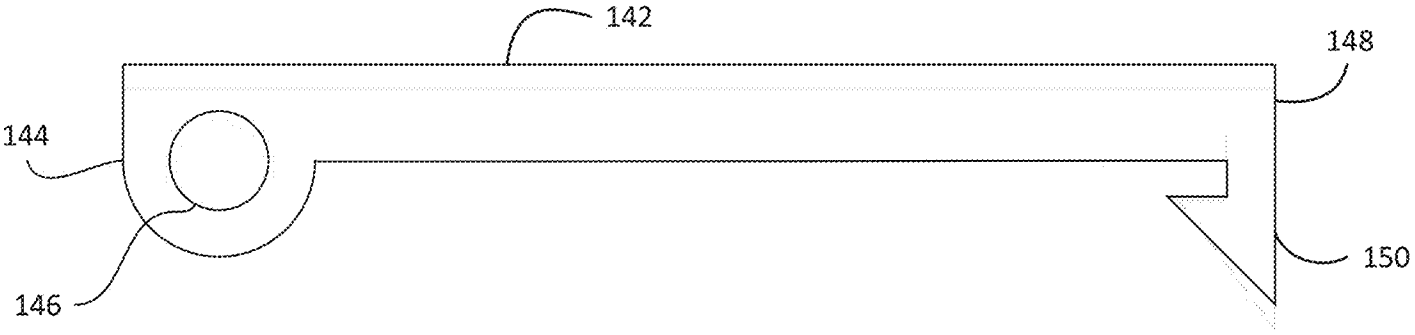
FIG. 3 is a side view of a retainer arm of the system shown in FIG. 1.

Some embodiments include a retainer arm 142. As shown in FIG. 3, the arm 142 has a first extremity 144 coupled to the base plate 102, for example by a pivot pin 146, and a second extremity 148 detachably connectable to the base plate 102, for example by a clip 150 that clips into a receptacle 152 in the base plate 102.

Figure 4:
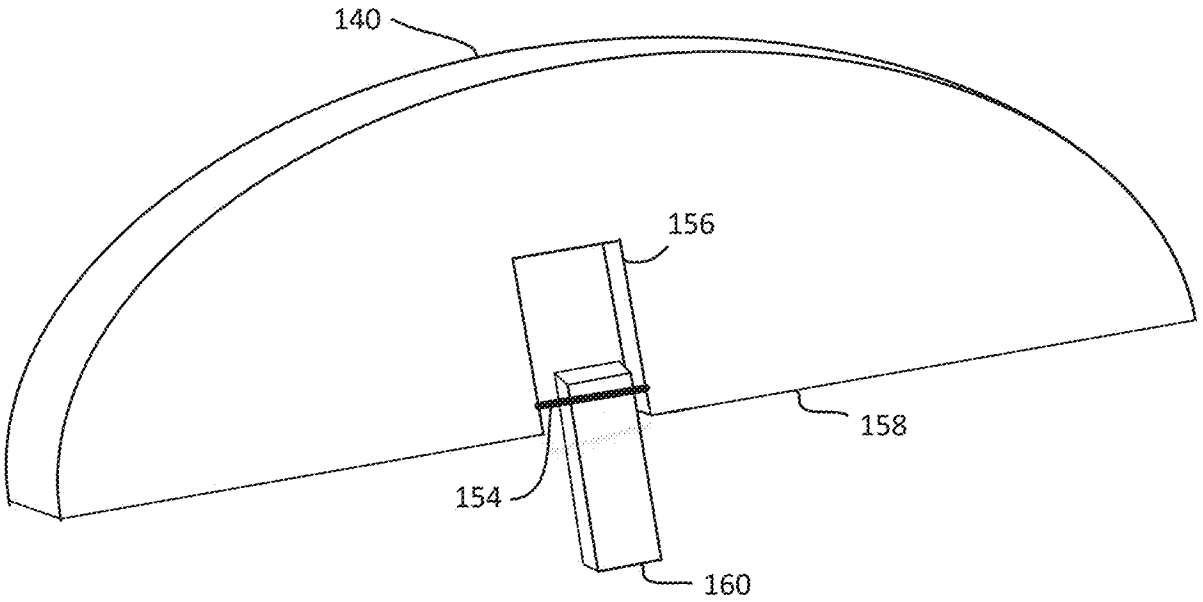
FIG. 4 is a close-up top view of a pinion gear and screw of the system of FIG. 1.

Referring to FIG. 4, an embodiment of the key 140 is shown in detail. A pin 154 is disposed in a notch 156 in an edge 158 of the key 140. The pin 154 goes through an extremity of a shaft 160 that connects the key 140 foldingly to the main gear 104.

The retainer arm 142 may extend across the main gear 104. The retainer arm 142 can be raised out of the way in order to use the key 140 to turn the main gear. In some embodiments there is no retainer arm and instead the main gear 104 is kept in place by pressure of a snowboard boot in the binding or by a cover plate as shown in FIG. 6.

Figure 5:
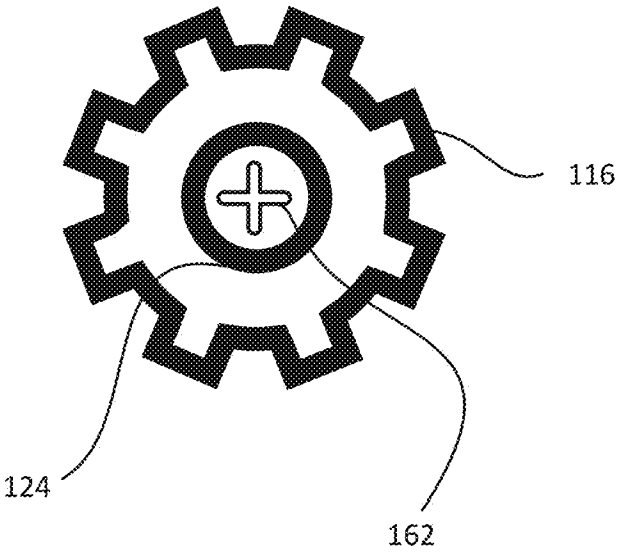
FIG. 5 is a perspective view of a turnkey of the system shown in FIG. 1.

FIG. 5 shows the pinion gear 116 with the screw 124 in place. The screw 124 has a Phillips head 162; other embodiments may use a slot head, an Allen head, or the like as desired. An upper surface of each pinion gear may be recessed so that the head of the screw lies flat with that surface.

Figure 6:
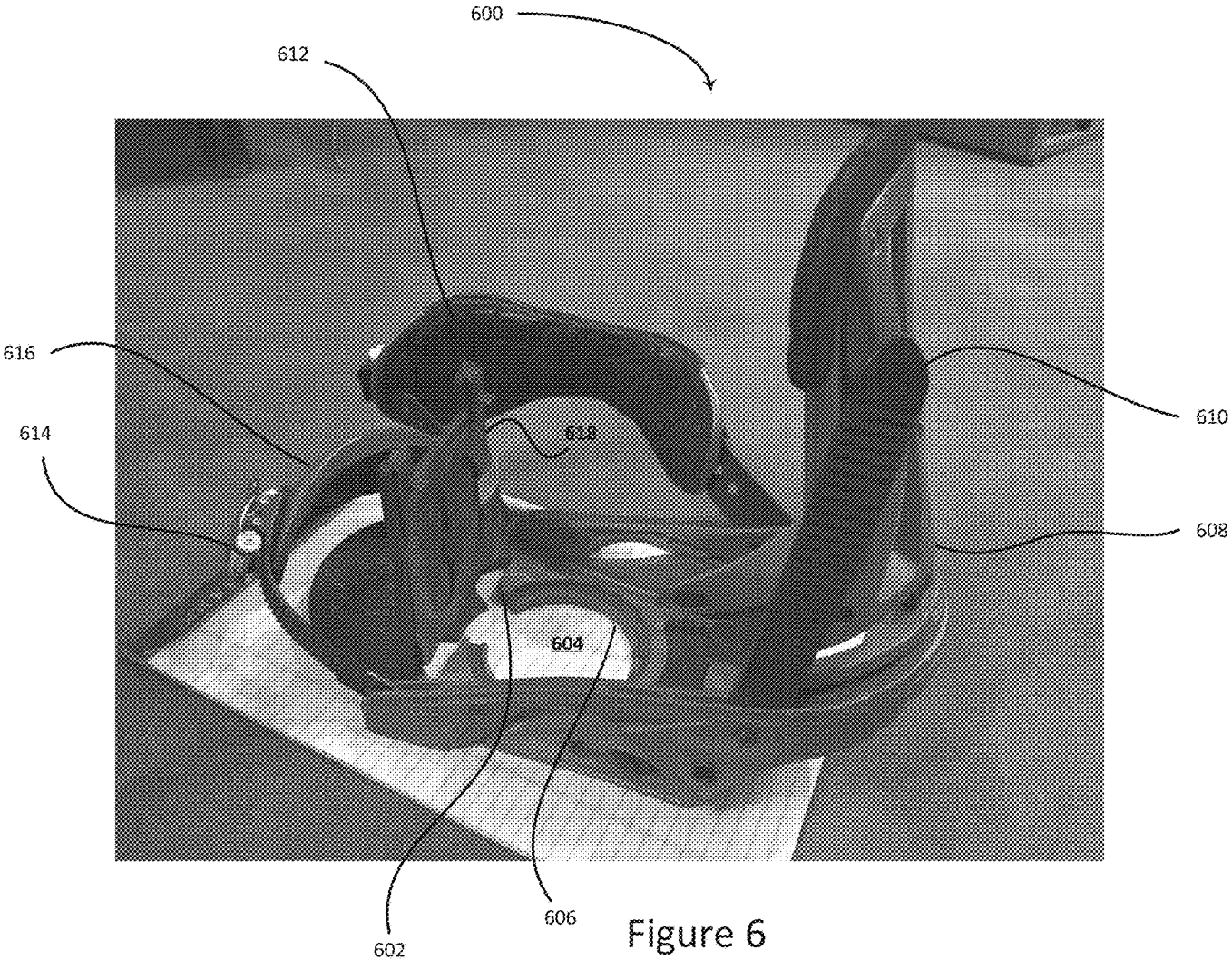
FIG. 6 is a perspective view of a snowboard binding including a snowboard binding mounting system.

FIG. 6 shows a snowboard binding generally 600 with which the above-described system may be used. The binding 600 has a mounting plate 602 that defines a circular opening 604. The base plate 102 is sized to fit snugly in the opening 604. The serrations 138 in the base plate 102 mate with corresponding serrations 606 in the mounting plate 602 when the base plate 102 is pressed into the opening 604. The binding includes a highback 608, mating ankle straps 610 and 612, and mating toe straps 614 and 616. A cover 618 is foldingly attached to the mounting plate 602 adjacent the toe straps 614 and 616 so that after the base plate has been installed in the opening 604 and secured to the snowboard with the mounting screws 124, 126, 128, and 130, the cover 618 is folded flat against the mounting plate 602, covering the base plate 102. Some snowboard bindings do not have any cover, and in this case a retainer such as the retainer arm 142 should be provided to hold the main gear in place.

Another embodiment of a snowboard binding mounting system has some features similar to those already described and illustrated. This snowboard binding mounting system includes a circular base plate having a beveled peripheral edge complemental with an edge of a base-plate opening in a mounting plate of a snowboard binding. The base plate has a recessed area defined in an upper surface of the base plate and four screw openings defined through the base plate at intervals around the recessed area. A main gear is centered in the recessed area of the base plate. A plurality of pinion gears are meshed with the main gear. Each pinion gear has a shaft opening aligned with one of the screw openings. Each of a plurality of screws defines a shaft connected to one of the pinion gears. Each shaft extends through the shaft opening of its pinion gear and through the corresponding screw opening. Complemental serrations may be formed in the beveled peripheral edge of the base plate and the edge of the base-plate opening in the binding mounting plate.

Figure 7:
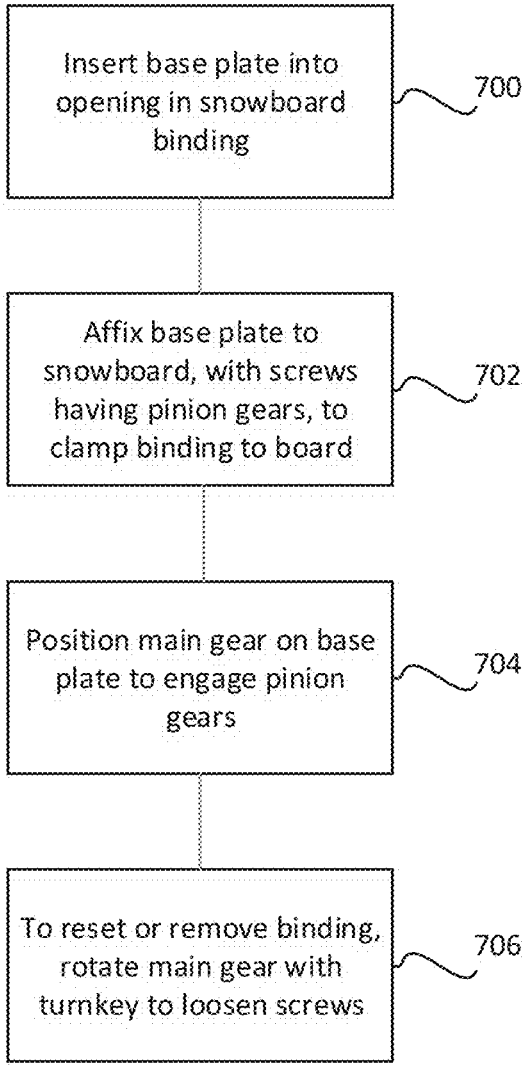
FIG. 7 is a flowchart showing a method of using a snowboard binding mounting system.

FIG. 7 shows a method of operating a snowboard binding system of the kind described above. A base plate including a mechanism as described is inserted into an opening in a mounting plate of a snowboard binding (700). The base plate is affixed to the snowboard using screws connected to pinion gears in the base plate, thereby clamping the snowboard binding to the snowboard (702). After the screws have been individually tightened, for example with a screwdriver, a main gear is positioned on the base plate, in a recess if one is provided, such that it engages the pinion gears and prevents the screws from turning individually (704). If it is desired to reset the snowboard binding or to remove it entirely from the snowboard, the turnkey is unfolded and used to manually turn the main gear so as to loosen or tighten all screws at once (706).

The foregoing description and attached drawings are illustrative only. The invention is limited only by the claims.

I claim:

1. A snowboard binding mounting system comprising:

a base plate and a main gear disposed on the base plate, the base plate engageable with a snowboard binding, the base plate having a plurality of screw openings each extending through the base plate and disposed around a circumference defined by the main gear;

a plurality of pinion gears disposed on the base plate and meshed with the main gear, each pinion gear having a shaft opening aligned with a corresponding one of the screw openings; and a plurality of screws, each screw defining a shaft that extends through one of the pinion gear shaft openings and the corresponding screw opening, wherein the base plate is round.

2. The system of claim 1 wherein the base plate defines a recessed area and the main gear and pinion gears are disposed in the recessed area.

3. The system of claim 1 wherein a peripheral edge of the base plate is engageable with a complementary edge of an opening in a mounting plate of the snowboard binding.

4. The system of claim 3 wherein the peripheral edge of the base plate is beveled and serrated and the opening in the mounting plate is matingly beveled and serrated.

5. The system of claim 1 wherein the screw openings define a square about 40 mm on a side with one screw opening at each corner of the square.

6. The system of claim 1 wherein the screw openings define a triangle with one opening at each vertex of the triangle.

7. The system of claim 1 wherein each screw is rigidly connected to its corresponding pinion gear.

8. The system of claim 1 wherein each screw is frictionally engaged with its corresponding pinion gear.

9. The system of claim 1 wherein the main gear comprises an internal gear disposed around the pinion gears.

10. The system of claim 1 wherein the main gear comprises an external gear disposed between the pinion gears.

11. The system of claim 10 and further comprising a key coupled to the main gear.

12. The system of claim 11 wherein the key is foldable onto the main gear.

13. The system of claim 1 and further comprising a retainer arm having a first extremity foldingly coupled to the base plate and a second extremity detachably connectable to the base plate.

14. A snowboard binding mounting system comprising:

a base plate and a main gear disposed on the base plate, the base plate engageable with a snowboard binding, the base plate having a plurality of screw openings each extending through the base plate and disposed around a circumference defined by the main gear;

a plurality of pinion gears disposed on the base plate and meshed with the main gear, each pinion gear having a shaft opening aligned with a corresponding one of the screw openings; and a plurality of screws, each screw defining a shaft that extends through one of the pinion gear shaft openings and the corresponding screw opening, wherein:

the base plate is circular in shape and includes a beveled peripheral edge complemental with an edge of a base-plate opening in a mounting plate of a snowboard binding and a recessed area defined in an upper surface of the base plate; and the main gear is disposed in the recessed area of the base plate; and further comprising a key foldingly coupled to the main gear.

15. The system of claim 14 and further comprising complemental serrations formed in the beveled peripheral edge of the base plate and the edge of the base-plate opening in the mounting plate.

16. The system of claim 14 and further comprising a pin in a notch defined in an edge of the key and a shaft connected to the main gear, the pin extending through an extremity of the shaft.

17. The system of claim 14 and further comprising a retainer arm extending across the main gear, a hinge coupling a first extremity of the retainer arm to the base plate, and a clip detachably coupling a second extremity of the retainer arm to the baseplate.

18. A snowboard binding including a binding mounting system comprising:

a mounting plate having an opening therethrough;

a highback connected to a heelside extremity of the mounting plate;

an ankle strap extending across the mounting plate adjacent the highback;

a toe strap extending across the mounting plate opposite the ankle strap;

a circular base plate having a beveled peripheral edge complemental with an edge of the opening in the mounting plate, a recessed area defined in an upper surface of the base plate and four screw openings defined through the base plate at regular intervals around the recessed area;

a main gear centered in the recessed area of the base plate;

four pinion gears each meshed with the main gear and each having a shaft opening aligned with one of the screw openings;

four screws each defining a shaft connected to one of the pinion gears and extending through the shaft opening of that pinion gear and through the corresponding screw opening;

a key foldingly coupled to the main gear; and a detachable cover extending over the base plate and at least a portion of the mounting plate.

* * * * *